US009394041B2

(12) United States Patent
Hilbert et al.

(10) Patent No.: US 9,394,041 B2
(45) Date of Patent: Jul. 19, 2016

(54) RIGHTING DEVICE FOR A WATER VESSEL

(71) Applicant: MARINE SPECIALISED TECHNOLOGY LIMITED, Liverpool Merseyside (GB)

(72) Inventors: Philip Hilbert, Heswall Wirral (GB); Ben Kerfoot, Nr. Tarporley (GB); Andy Phillips, Macclesfield (GB); Chris Chadwick, Lancaster (GB)

(73) Assignee: Marine Specialised Technology Limited, Liverpool Merseyside (GB)

( * ) Notice: Subject to any disclaimer, the term of this patent is extended or adjusted under 35 U.S.C. 154(b) by 0 days.

(21) Appl. No.: 14/391,405

(22) PCT Filed: Apr. 3, 2013

(86) PCT No.: PCT/GB2013/050874

§ 371 (c)(1),
(2) Date: Oct. 9, 2014

(87) PCT Pub. No.: WO2013/153363

PCT Pub. Date: Oct. 17, 2013

(65) Prior Publication Data

US 2015/0059634 A1 Mar. 5, 2015

(30) Foreign Application Priority Data

Apr. 10, 2012 (GB) ..... 1206319.4

(51) Int. Cl.
*B63B 7/00* (2006.01)
*B63C 7/00* (2006.01)
*B63B 7/08* (2006.01)

(52) U.S. Cl.
CPC ..... *B63C 7/003* (2013.01); *B63B 7/082* (2013.01)

(58) Field of Classification Search
CPC ..... B63C 7/003; B63B 7/082
USPC ..... 114/345
See application file for complete search history.

(56) References Cited

U.S. PATENT DOCUMENTS 5,056,453 A * 10/1991 Wright ..... B63C 7/003 114/345

FOREIGN PATENT DOCUMENTS

GB 1511243 A 5/1978
KR 20020025112 A 4/2002

OTHER PUBLICATIONS

International Search Report; International application No. PCT/GB2013/050874; date of mailing Aug. 7, 2013.

* cited by examiner

*Primary Examiner* — Stephen Avila
(74) *Attorney, Agent, or Firm* — Brooks Kushman P.C.

(57) ABSTRACT

A device for righting a boat or other water vessel following a capsize. The device has an inflatable body which can be stowed in a collapsed state when uninflated. Compressed gas inflates the body following a capsize. The inflatable body has a flexible skin which forms at least first and second inflatable chambers. A valve arrangement causes the chambers to be inflated in a predetermined sequence. The first chamber securely mounts the valve upon the vessel. The second chamber is coupled to the first, supported by the first chamber when the device is deployed. Due to its buoyancy when submerged, the second chamber applies a righting moment to the vessel. The first chamber transmits this moment to the vessel. The staged inflation of the body alleviates its tendency to "pop up" to the surface before it is adequately inflated.

13 Claims, 10 Drawing Sheets

RIGHTING DEVICE FOR A WATER VESSEL

CROSS REFERENCE TO RELATED APPLICATIONS

This application is the U.S. national phase of PCT application no. PCT/GB2013/050874 filed Apr. 3, 2013, which claims priority to Great Britain application No. GB 1206319.4, filed Apr. 10, 2012.

BACKGROUND OF THE INVENTION (1) Field of the Invention

The present invention is concerned with righting of boats following capsize and particularly with an inflatable device for that purpose.

(2) Desrciption of Related Art

Some boats are inherently unstable in an inverted condition and so tend to right themselves without assistance following a capsize. Others, such as sailing dinghies, can be righted by the crew while at sea. However some boats will float stably in an inverted condition following capsize and can be difficult to right. Rigid inflatable boats ("RIBs") typically fall in this category. Clearly this poses dangers to the crew.

It is known in the art that such boats can be provided with what are referred to as self-righting devices—that is, devices which will right the boat without external intervention. An example of a vessel fitted with a self-righting device is seen in FIG. 1. This is a rigid inflatable boat (RIB) 10 of well known type, having a rigid hull 12 with inflatable tubes 14 extending along its gunwales on both sides. Boats of this general type come in a wide range of sizes and are used in many different roles. They may for example serve as military craft, as lifeboats, as tenders for larger craft etc. The example illustrated has an inboard engine but RIBs often use transom-mounted outboard engines. At the rear of the RIB 10 is a rigid arch 16 standing well above the hull and formed of metal tubing. An inflatable float 18 is mounted on a crossbar 19 at the top of the arch 16. In normal operation the float 18 is deflated and stowed in a compact configuration (not shown in the drawing) on the crossbar 19. If the RIB is overturned, by heavy seas for example, pressurised gas is supplied to the float 18 to inflate it. Clearly with the RIB 10 inverted, the float is submerged. When inflated the float 18 becomes buoyant and seeks a route to the surface. The rigid arch 16 serves as a lever through which the float 18 exerts a righting moment on the boat, causing it to roll back to an upright orientation.

The float 18 is inflated using a pressurised gas cylinder and associated valve which are not seen in the drawing.

While effective, self-righting devices of the illustrated type are not suited to all applications. In particular provision of the rigid arch 16 or some other raised, fixed structure through which the float 18 can exert the required leverage can be problematic. Where the RIB 10 is to be used as a gunboat, for example, it is important that the gun platform should have a full 360 degree view. The rigid arch 16 of FIG. 1 would potentially prevent targeting of objects behind the RIB 10, which is undesirable. Another potential problem is that a boat used as a tender may need to be stored on the parent vessel in a space with limited headroom in which the arch 16 could not be accommodated.

One might imagine that the float 18 could be replaced with a larger inflatable float mounted on the deck or transom but in practice this proves ineffective. Experience shows that a float of this type tends, in use, to pop up to the surface beside the inverted boat before it is adequately inflated, making it incapable of righting the boat.

Prior art document U.S. Pat. No. 5,056,453 (Wright) describes a rigid inflatable boat with a self-righting apparatus in the form of an inflatable arch whose ends are each anchored to a respective tube of the RIB. That is, the arch spans the entire width of the RIB. It seems to be envisaged that the arch will be formed by a single inflatable chamber to be inflated following a capsize, and that this structure will naturally tend to inflate more rapidly on one side than the other so that its asymmetric buoyancy will determine the direction in which the boat rolls. Certain drawbacks are apparent. The arch depicted in the document appears to be mounted upon and integrated with the inflatable tubes of the RIB, potentially complicating the boat's manufacture. Storage of the deflated arch, which necessarily extends right across the RIB, may also prove problematic. It is not known how effective this design would be in practice.

Hence a need exists for an improved self-righting device for a boat or other vessel. It is particularly desirable that this device should have a low profile when stowed.

BRIEF SUMMARY OF THE INVENTION

In accordance with a first aspect of the present invention, there is a device for righting a boat or other water vessel following a capsize, the device comprising an inflatable body adapted to be stowed in a collapsed state when un-inflated, the inflatable body being provided with or adapted for connection to a source of compressed gas for inflating the body following a capsize and comprising a flexible skin forming first and second inflatable chambers, the device further comprising a valve arrangement for causing the chambers to inflate in a predetermined sequence in which the first chamber is inflated before the second, the first chamber being provided with means for securely mounting it upon the vessel whereas the second chamber is coupled to the first chamber and is arranged, when the body is inflated, to be supported by it, so that due to its buoyancy the second chamber is able to apply a righting moment which is transmitted through the first chamber to right the vessel.

By virtue of the sequential inflation of the first and second chambers, it is possible to establish an adequately rigid base or support for the second chamber before it is inflated, providing the buoyancy needed to right the vessel.

The present invention makes it possible to provide a wholly inflatable device which has a low profile when stowed and which is suitable for mounting at deck or transom level without any rigid upstanding support structure.

In accordance with a second aspect of the present invention, there is a method of righting a boat or other vessel following capsize, comprising providing an inflatable body comprising a flexible, gas impermeable outer skin forming first and second inflatable chambers, mounting the inflatable body upon the vessel and stowing it in a collapsed, uninflated state, following a capsize of the vessel, supplying compressed gas to the first inflatable chamber and then; following inflation of the first inflatable chamber, to the second inflatable chamber to deploy the inflatable body and cause it to right the vessel.

BRIEF DESCRIPTION OF THE SEVERAL VIEWS OF THE DRAWINGS

Specific embodiments of the present invention will now be described, by way of example only, with reference to the accompanying drawings in which.

DETAILED DESCRIPTION OF THE INVENTION

Figure 1:
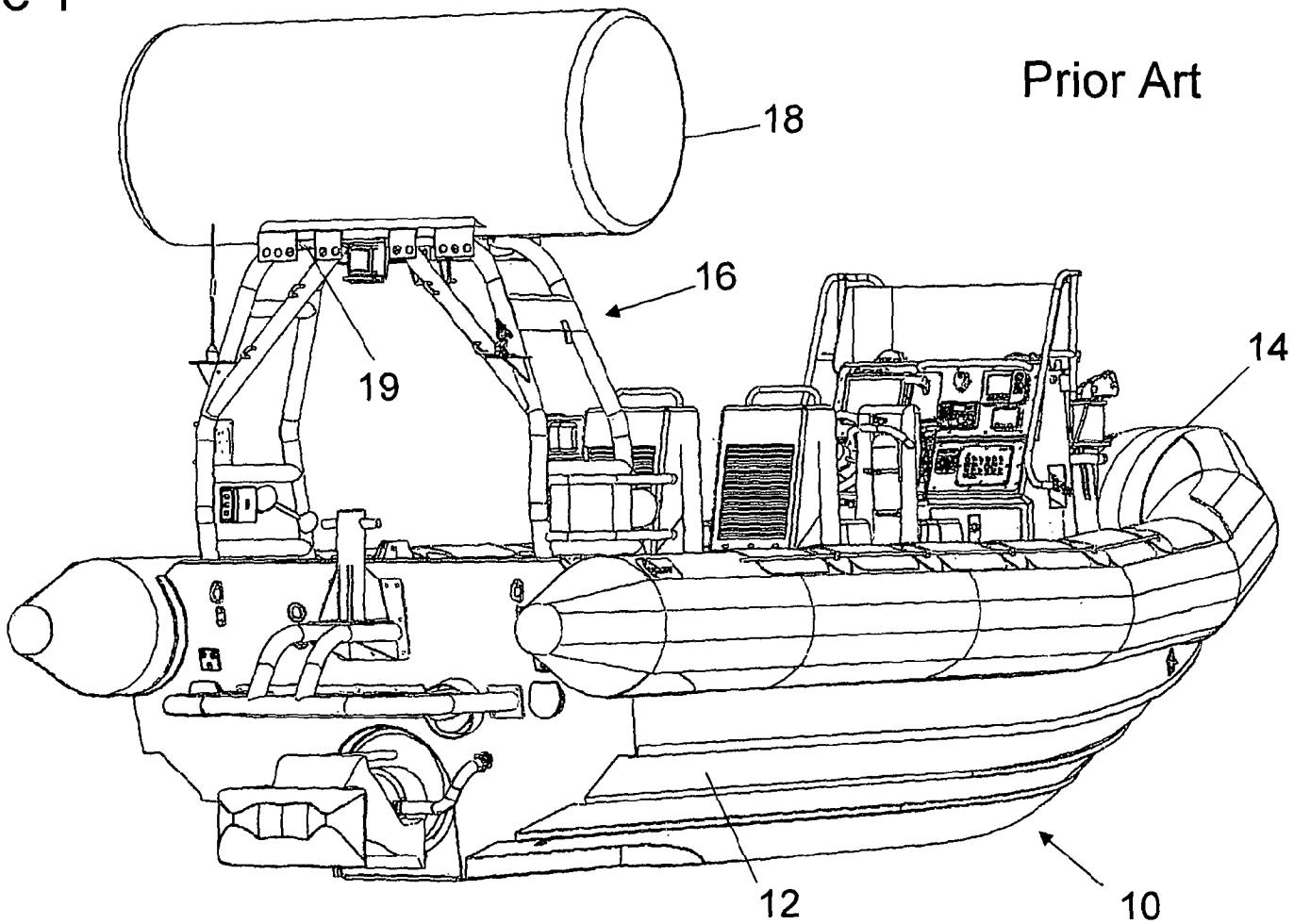
FIG. 1 is a perspective illustration of a rigid inflatable boat fitted with a self-righting device belonging to the prior art.
Figure 2:
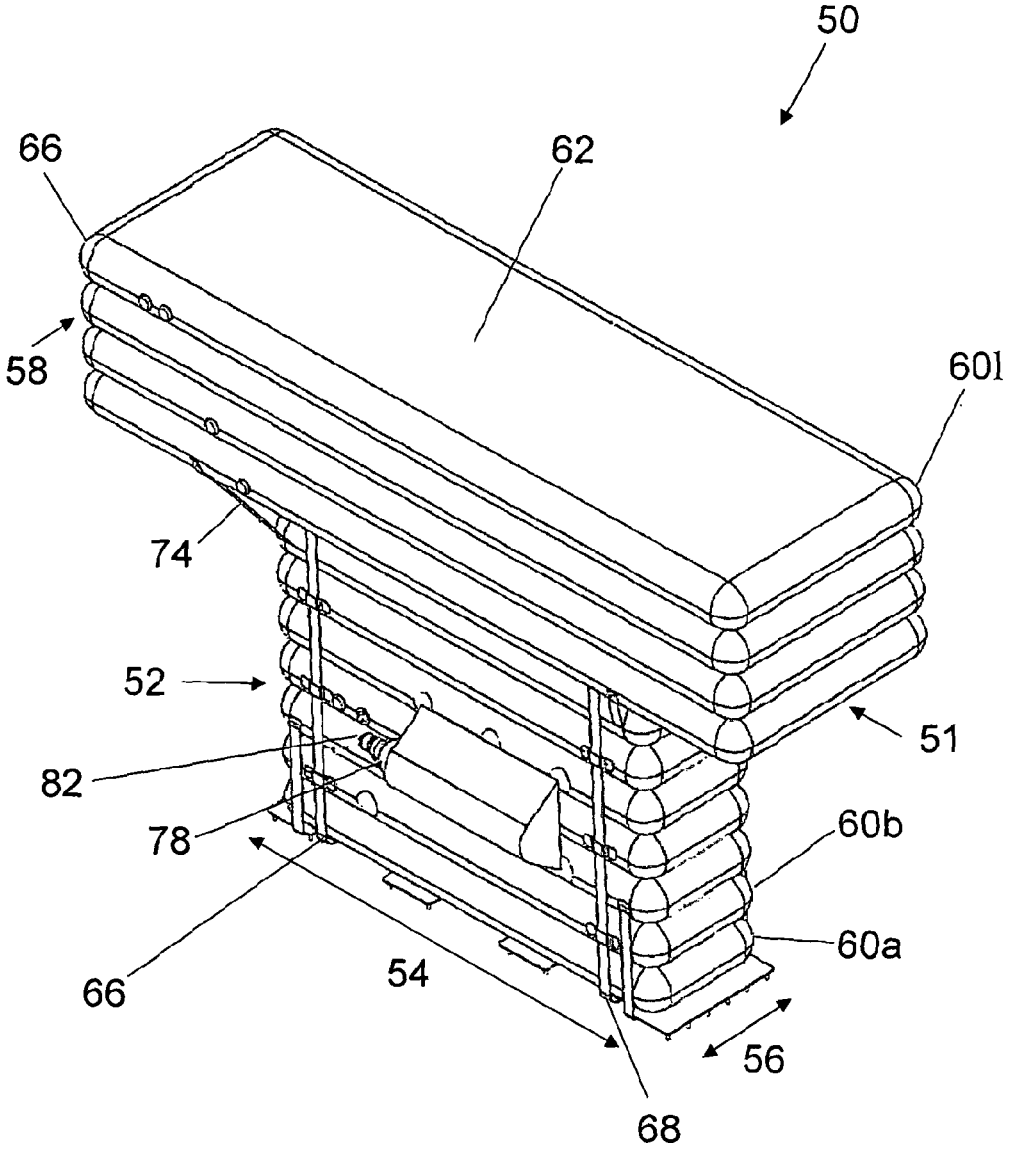
FIG. 2 is a perspective illustration of a self-righting device embodying the present invention, shown in its inflated state.
Figure 3:
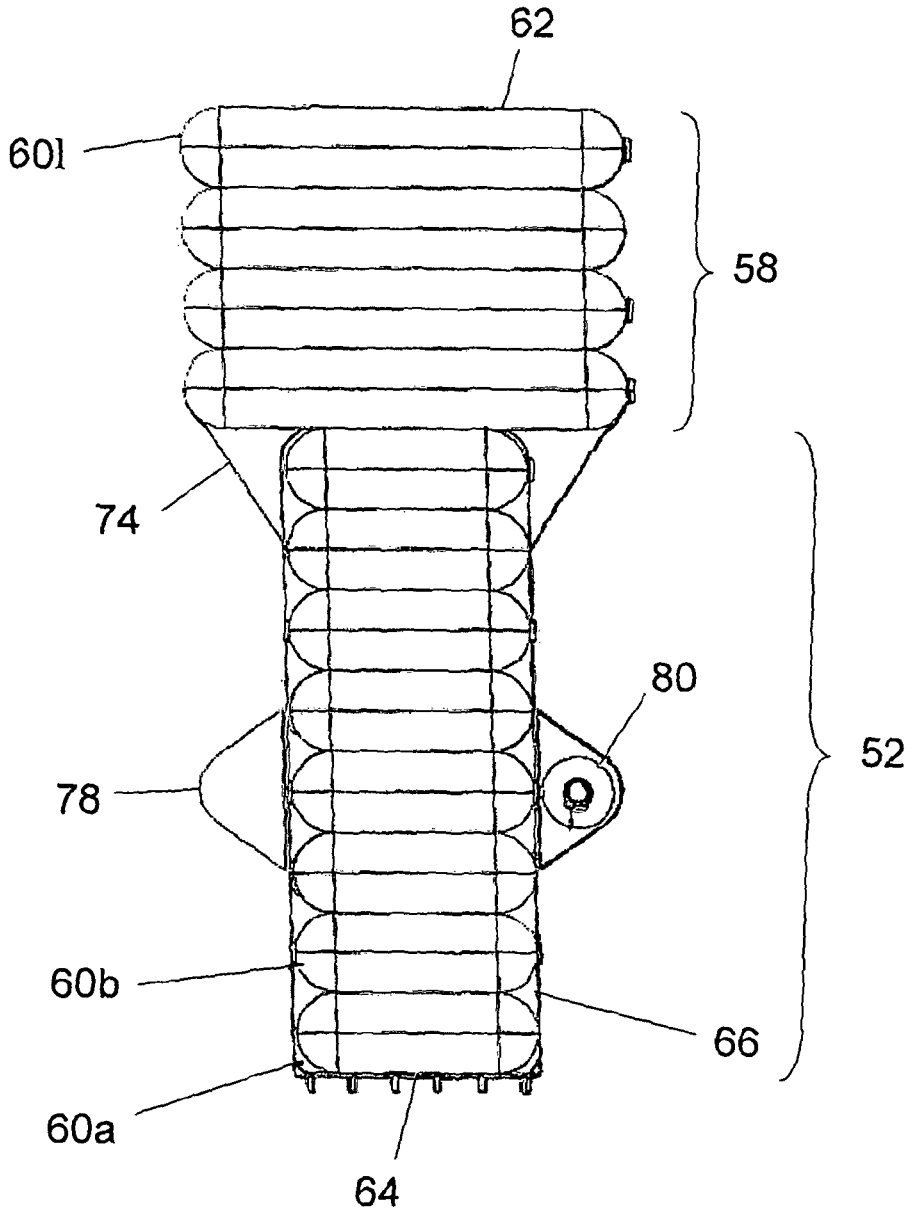
FIGS. 3 and 4 are respectively end and side elevations of the same self-righting device, again in its inflated state.
Figure 4:
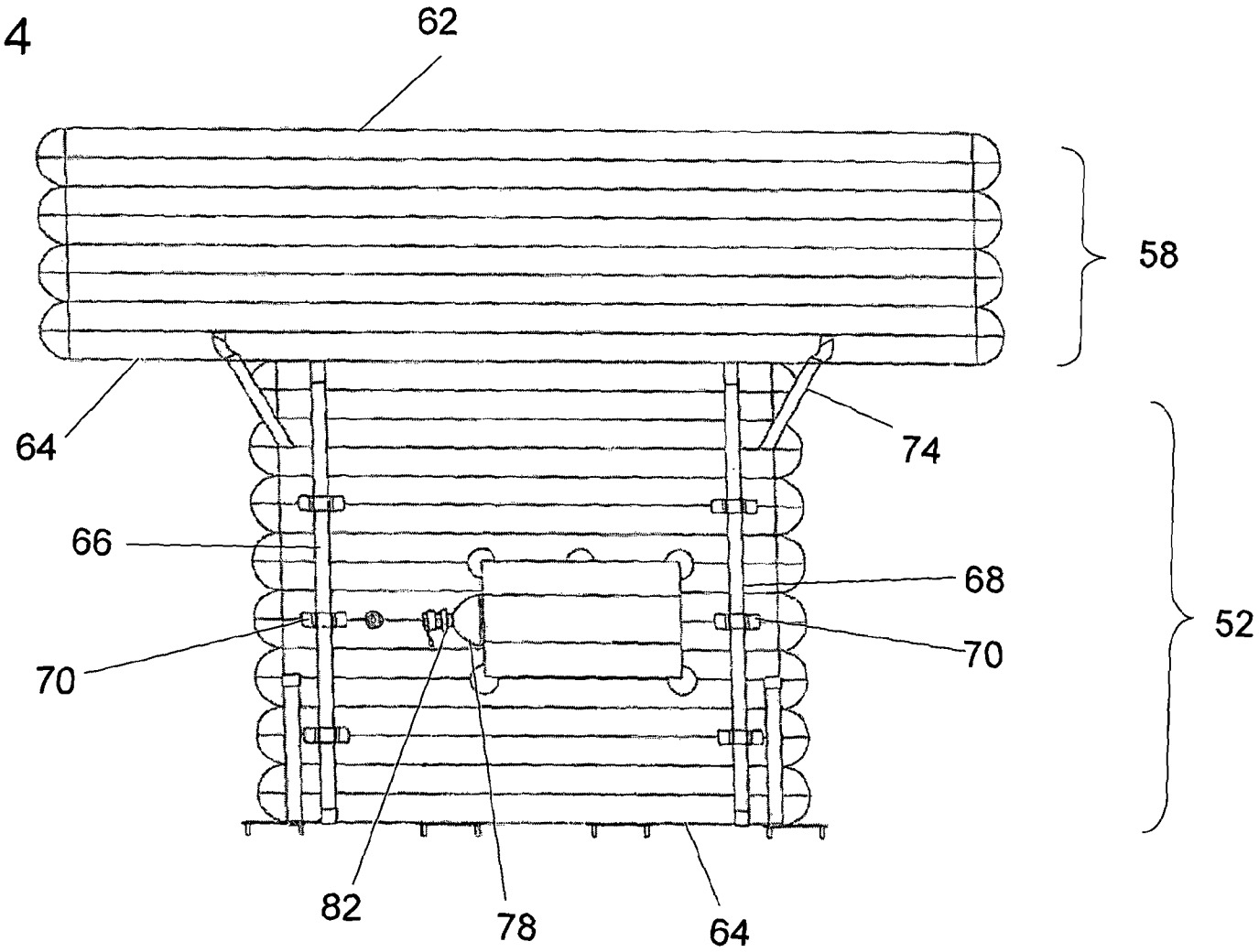

The righting device 50 seen in FIGS. 2 to 5 has a body 51 which is wholly inflatable. That is, it does not have or require an upstanding supporting structure such as the arch 16 of FIG. 1. When collapsed it forms a compact package which can be mounted at deck level or on a boat's transom. Thus for example if the vessel in question is a gunboat, the device need not impede the gun's line of sight along any direction. The inflatable body 51 is divided, as will be explained below, into multiple chambers whose sequence of inflation is controlled by an arrangement of valves through which the chambers are connectable to one another. By controlling the sequence of inflation in this way, and by suitable design of the body 51, the natural tendency for the inflatable body to pop up to the surface prematurely is resisted.

In the illustrated embodiment the inflatable body 51 has a lower portion 52 of relatively small width 54 and depth 56, and an oversized upper portion 58. Due to its greater width and depth the upper portion contributes considerable buoyancy in operation and it will be referred to below as the float portion 58. The lower portion serves to carry the float portion 58 and will for this reason be referred to as the support portion 52. Note however that these designations are somewhat arbitrary—clearly every part of the body 51, including the support portion 52, contributes buoyancy when inflated and submerged, and each layer of the body 51 supports layers above it.

Note that throughout this document the terms "upper" and "lower" refer to the orientation of the righting device 50 when it is mounted on a vessel ready for use and that vessel is right way up, not capsized. Related terms such as "above" and "below" are to be similarly construed.

According to the illustrated embodiment the inflatable body 51 comprises multiple layers 60*a* to 60*l* each of which comprises an impermeable, flexible outer skin having upper and lower panels 62, 64 joined by a perimeter wall 66 to form an internal plenum. Each layer 60*a* . . . *l* communicates with its neighbour or neighbours so that gas can flow from one layer to another, although in some cases this flow of gas is regulated by an arrangement of valves. This aspect will be explained in more detail below.

In the illustrated embodiment the upper and lower panels 62, 64 are coupled to one another at multiple points by an internal structure in a manner which contributes to the rigidity of the layers 60*a* . . . *l*. This internal structure defines the separation of the upper and lower panels 62, 64 and resists their natural tendency, when pressurised, to bulge away from one another. As a result the height of each of the layers 60*a* . . . *l* is roughly constant across its width and depth and the upper and lower panels 62, 64 are substantially flat and mutually parallel. The internal structure also prevents excessive shear of the upper and lower panels 62, 64 relative to one another. The rigidity of the entire inflatable body 51 is greatly improved as a result. The layers' internal structure is flexible and does not prevent them from being compressed and folded for storage.

More specifically, the layers 60*a* . . . *l* of the present embodiment comprise drop thread fabric which forms the aforementioned internal structure. This material is known to those skilled in the art of inflatables and is also referred to as drop stitch fabric. Upper and lower fabric panels are coupled to one another by an interlocking warp which may be created by a stitching process using multiple needles and which typically comprises a high density of fine threads, e.g. of polyester or nylon, running from one fabric layer to the other. The fabric is rendered gas impermeable by application of an outer skin, which in the present embodiment is of neoprene.

The layers 60*a* . . . *l* form a stack with the upper panel 62 of one panel being secured, and more specifically being bonded, to the lower panel 64 of the layer above.

Figure 6:
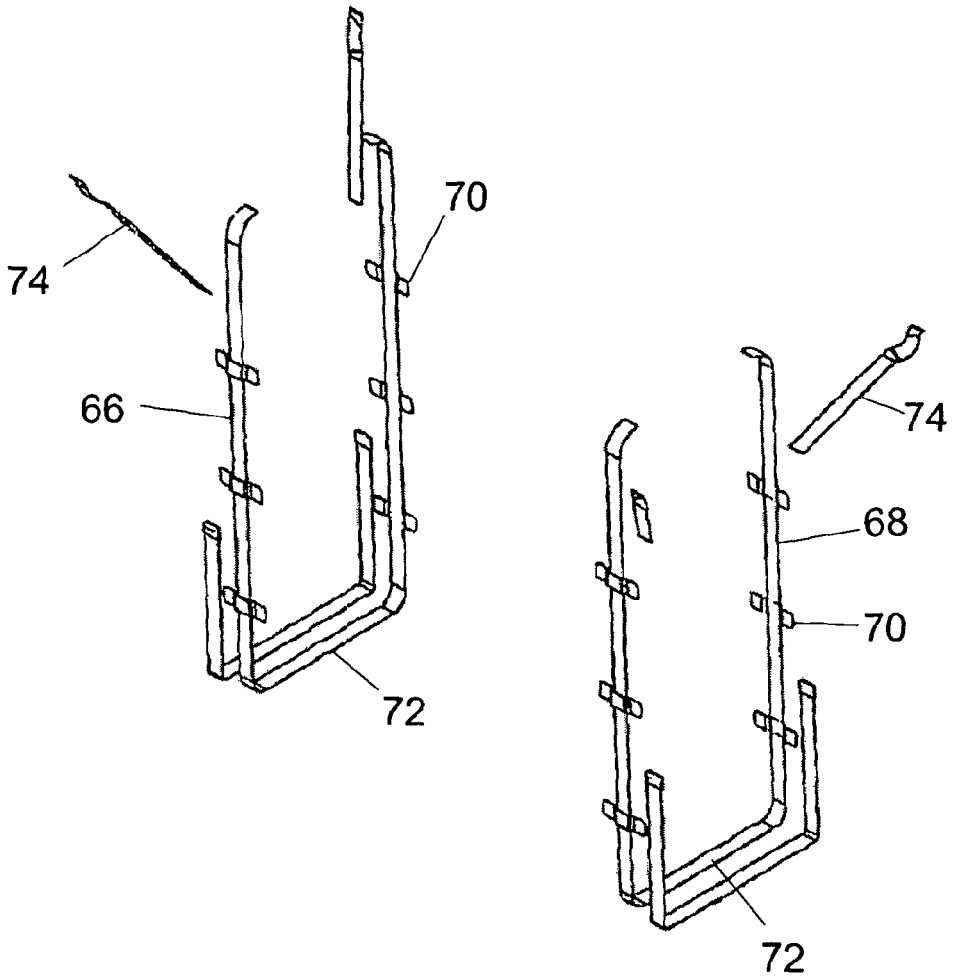
FIG. 6 shows, in perspective and without any other parts of the device, a pair of straps forming part of the self-righting device.

A further contribution to rigidity of the support portion 52 is made by straps arranged around it. In the illustrated embodiment there is a pair of straps 66, 68 each of which forms a "U" shape when the device is inflated (see FIG. 6 in particular). The material forming the straps is flexible but has high tensile strength and tensile stiffness. Woven webbing is used in the illustrated embodiment. Tabs 70 of the same material are bonded to the support portion 52 at intervals up its height forming loops through which the straps 66, 68 are passed (see FIG. 4). A base portion 72 of each strap 66, 68 (see FIG. 6 again) can be secured to a supporting structure (not shown) to securely mount the inflatable body 51 thereupon. Additional straps 74 are provided at each of the inflatable body's upright vertices and extend diagonally between anchor points on the support portion 52 and the float portion 58 to act as braces, further enhancing the body's rigidity when inflated.

It is desirable to provide some form of enclosure to store and protect the inflatable body 51 in its deflated and collapsed state when it is not in active use. This enclosure is not shown in the drawings and may take numerous different forms. For example the body could be stowed in a bag adapted to open or tear to release the inflatable body 51 as it inflates. An alternative is to stow the collapsed inflatable body 51 in a shallow box with a top panel forming a removable lid which will be pushed off as the body 51 inflates. The applicant envisages that a box of this type may be mounted on the upper edge of the transom of a RIB through suitably substantial brackets. The box itself would thus serve as a mounting and base for the righting device 50.

A source of compressed gas is needed to inflate the body 51 and in the illustrated embodiment this takes the form of a pair of gas bottles 78, 80 carried on opposite sides of the support portion 52. The gas used in the present embodiment is a mixture of nitrogen and carbon dioxide. Inflation valves 82 controlling release of gas are in the present example manually operable. In the event of capsize a typical crew drill involves first having the crew congregate in the water, typically holding onto a line attached to the boat, before one of the crew activates the righting device, e.g. by pulling on a further line to open the inflation valves 82, to deploy the righting device 50 and so right the vessel. In this way it can be ensured that crew are not in harm's way as the vessel is righted. However in principle the righting device 50 could use valves adapted to be released automatically upon immersion, e.g. by hydrostatic pressure and/or by sensing their own orientation.

The inflatable body 51 has multiple internal chambers controlled by an arrangement of valves which ensure that the chambers inflate in a predetermined sequence. The body's lower chambers, forming the support portion 52, are inflated before its upper chambers, forming the float portion 58. In this way an adequately rigid support is provided early in the inflation process. The larger float portion 58 is inflated only once this support has been deployed. The support portion 52 also forms a lever through which the float portion 58 can exert a moment on the vessel to right it.

Note that the term "chamber" is used herein to refer to an internal space of the inflatable body 51 through which gas can freely pass. This does not however imply that each such chamber is a simple plenum since, in the illustrated embodiment, each chamber is formed by multiple layers of the drop thread material. Within each chamber, neighbouring layers such as 60*a* and 60*b* communicate through an opening or openings in the upper panel of one layer 60*a* aligned with similar opening(s) in the lower panel of the next layer 60*b*. These openings are not seen in the drawings.

FIGS. 5*a* to 5*e* show a sequence of steps in the inflation process. In each of these drawings only the parts of the body 51 which have been inflated are shown. This simplifies and clarifies the drawings and also reveals certain relevant internal details. The illustrated embodiment has five chambers 91 to 95 arranged one above another and these are inflated in vertical order, from the lowermost chamber 91 to the uppermost chamber 95. Each chamber save for the uppermost chamber 95 communicates with the chamber above through a respective set of stage valves 100 to 103 which are normally closed and which open when pressure difference between the chamber below and the chamber above exceeds a predetermined threshold.

Figure 5A:
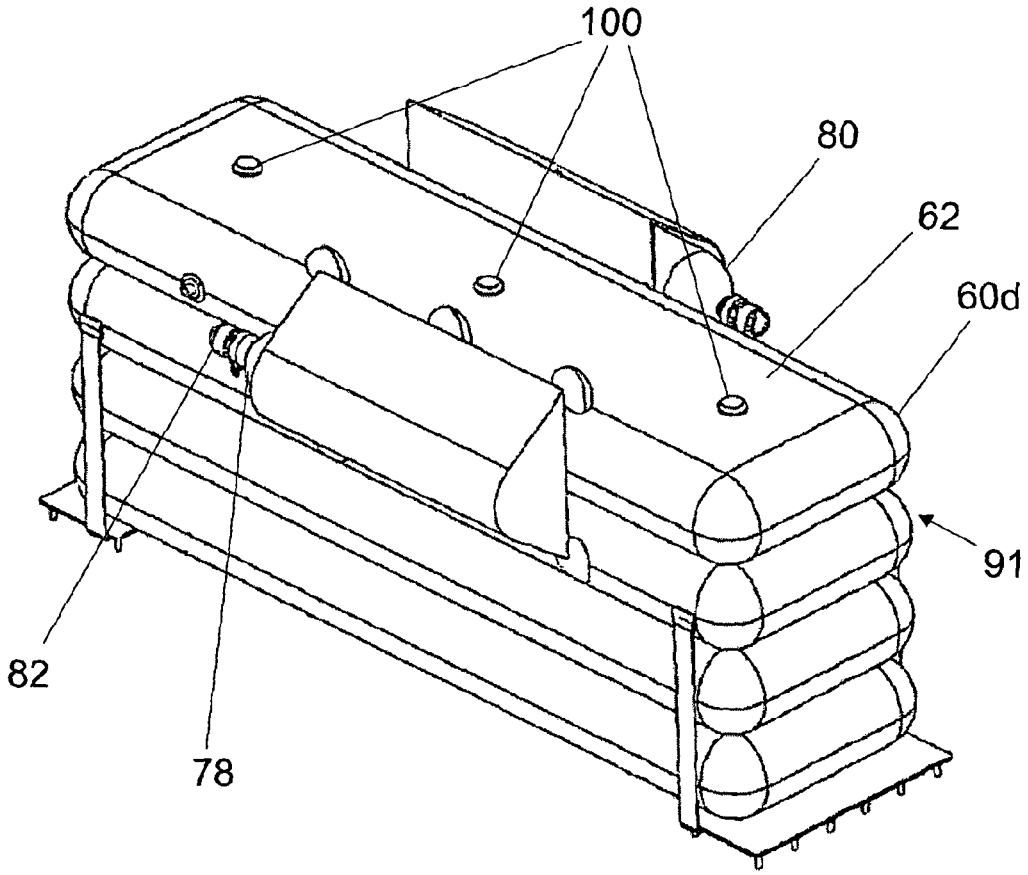
FIGS. 5 *a-e* illustrate the sequence in which chambers of the self-righting device are inflated, un-inflated chambers being omitted from these drawings.

When opened to initiate the self righting process, the inflation valves 82 supply gas directly to the first, lowermost, chamber 91 and this consequently inflates first as seen in FIG. 5*a*.

Figure 5B:
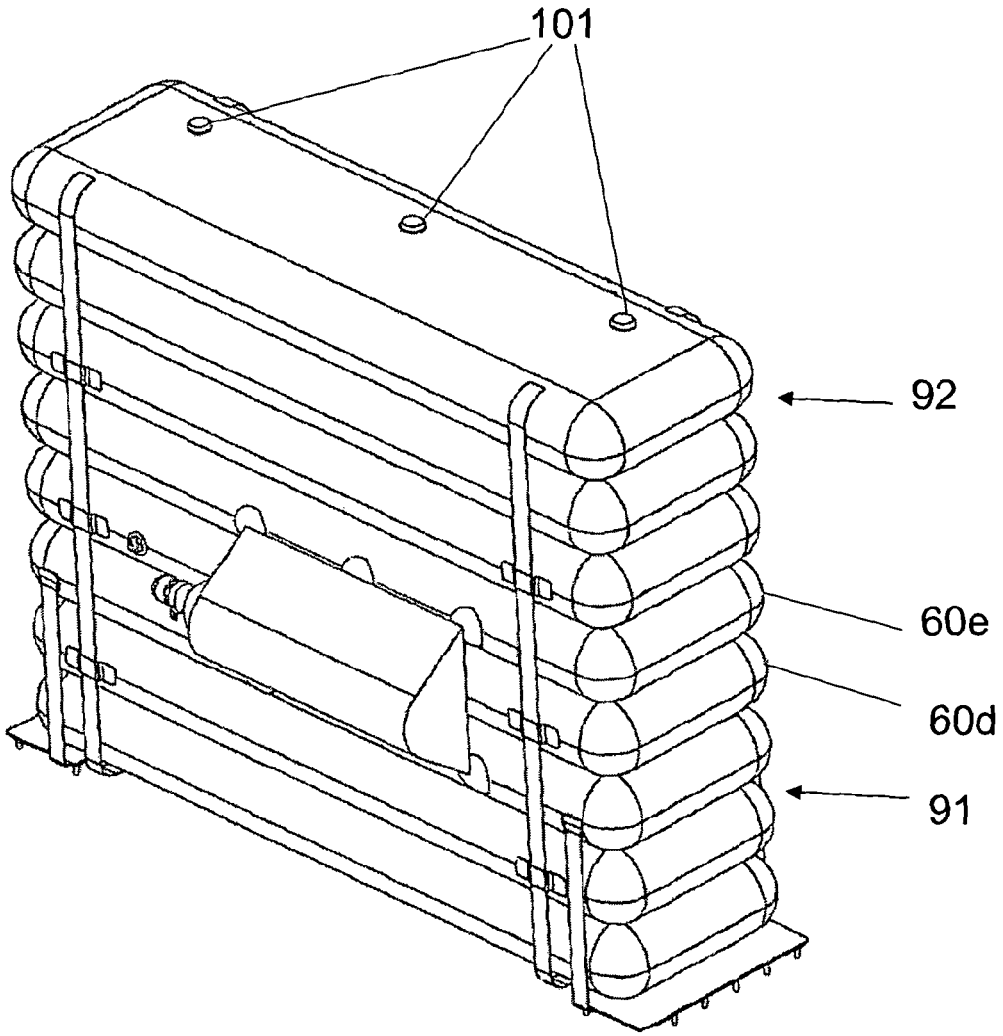

When the first chamber 91 reaches a predetermined pressure, first stage valves 100 open to allow gas to begin to flow from the first chamber 91 to the second chamber 92—see FIG. 5*b*. Three first stage valves 100 are seen in FIG. 5*a* but a different number could be used. They are mounted in openings leading from the upper panel 62 of the top layer 60*d* of the first chamber into the lower panel of the bottom layer 60*e* of the second chamber. The stage valves 100 to 103 can be formed as normally closed one way spring controlled valves. Suitable valves are well known to the skilled person and need not be described herein.

The first and second chambers 91, 92 together form the support portion 52.

Figure 5C:
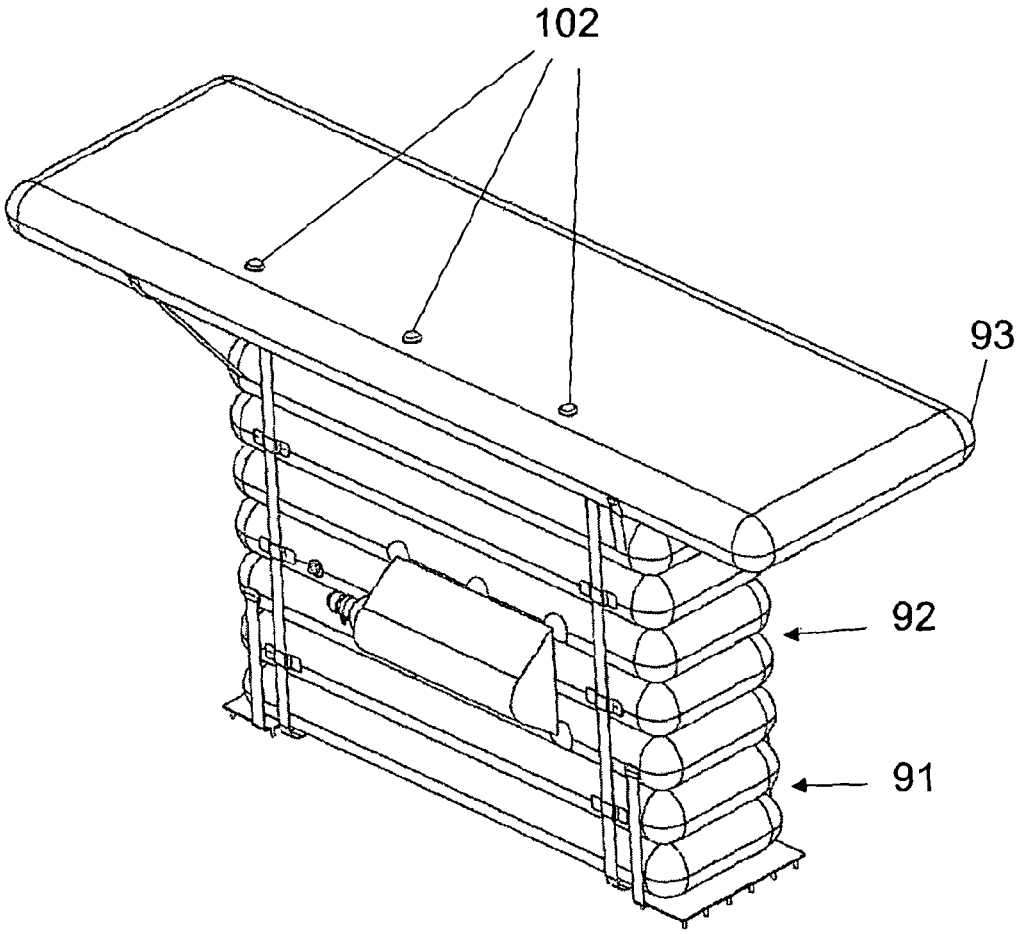

When pressure in the second chamber 92 becomes large enough to open the second stage valves 101, inflation of the third chamber 93 begins—see FIG. 5*c*. This is the first of the oversize chambers forming the float portion 58.

Figure 5D:
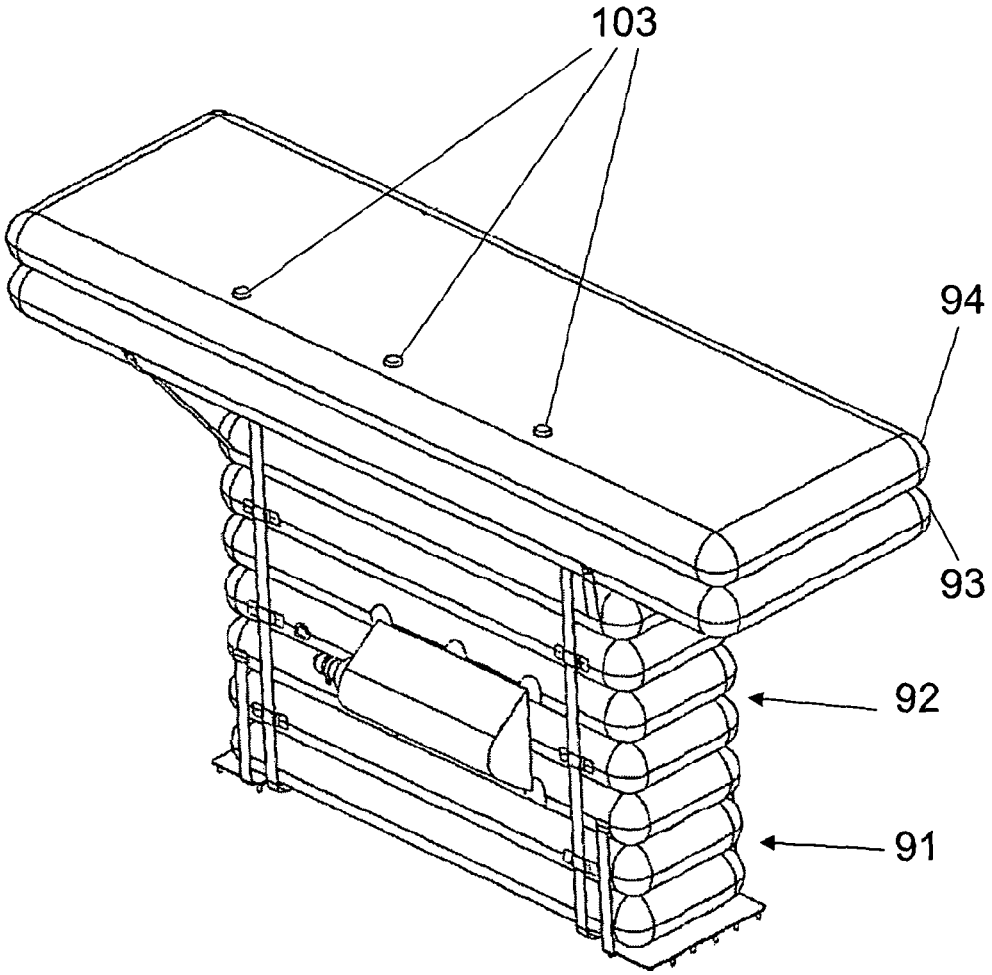
Figure 5E:
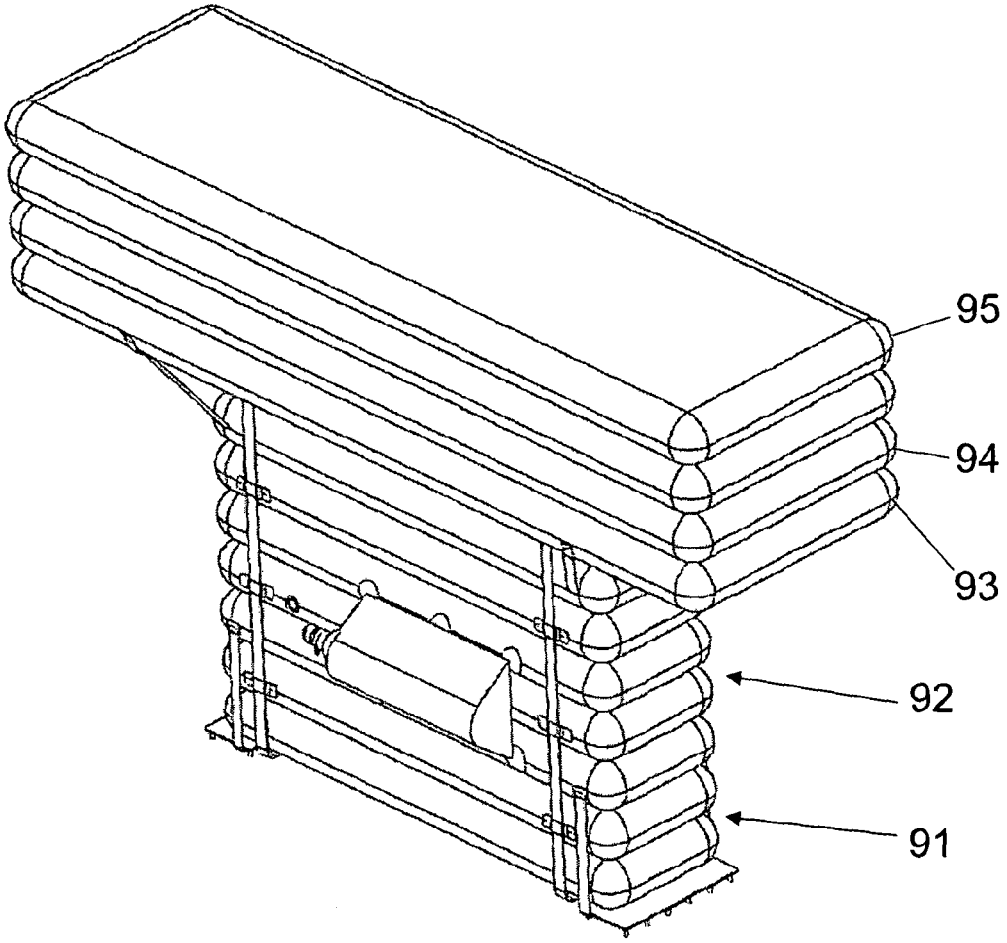

In similar manner, third and fourth stage valves 102, 103 then open in sequence to permit inflation of the fourth and fifth chambers 94, 95 of the float portion 58—see FIGS. 5*d* and 5*e*.

During or after this process of deployment, buoyancy of the body 51 tends to raise the stern of the vessel and, as the vessel turns to one side or the other, to exert a moment upon it, causing the vessel to roll back to an upright orientation.

Note that the stage valves 100 to 103 each serve to maintain a pressure difference between one chamber and the next. Hence following full inflation pressure is highest in the first chamber 91 and progressively reduces from the second to the fifth chambers 92 to 94. This is desirable—it results in the lower parts of the body, which bear the greatest loads, being relatively rigid.

The aforegoing embodiment is presented by way of example and not limitation. Numerous variations of design and function are possible without departing from the scope of the present invention as determined by the appended claims. For example while the illustrated embodiment uses five individual inflatable chambers, the actual number of chambers may vary according to design criteria, including for example the size of the vessel to be righted. The shape of the inflatable body is capable of considerable modification. The skilled person will recognise that the valve arrangement providing for sequential inflation of the chambers could take any number of different forms.

The invention claimed is:

1. A device for righting a boat or other water vessel following a capsize, the device comprising an inflatable body adapted to be stowed in a collapsed state when un-inflated, the inflatable body being provided with or adapted for connection to a source of compressed gas for inflating the body following a capsize and comprising a flexible skin forming first and second inflatable chambers, the device further comprising a valve arrangement for causing the chambers to inflate in a predetermined sequence in which the first chamber is inflated before the second, the first chamber being provided with means for securely mounting it upon the vessel whereas the second chamber is coupled to the first chamber and is arranged, when the body is inflated, to be supported by it, so that due to its buoyancy the second chamber is able to apply a righting moment which is transmitted through the first chamber to right the vessel, and wherein when the inflatable body is inflated and the vessel is right way up, the second inflatable chamber is disposed above the first inflatable chamber.

2. The device as claimed in claim 1 in which the valve arrangement comprises at least one valve through which the first chamber is connectable to the second, the valve being arranged to open when pressure in the first chamber exceeds pressure in the second chamber by more than a threshold value.

3. The device as claimed in claim 1 in which the first chamber comprises a plurality of layers, each having upper and lower panels between which a plenum is defined.

4. The device as claimed in claim 3 in which the upper and lower panels of each layer are joined at multiple locations within the plenum by an internal structure which determines separation between the upper and lower panels when the layers are inflated.

5. The device as claimed in claim 1 in which the first chamber comprises a plurality of layers of drop thread material.

6. The device as claimed in claim 5 in which the layers of drop thread material are stacked one upon another.

7. The device as claimed in claim 1 in which the valve arrangement comprises (a) an inflation valve, the opening of which permits gas to pass from the compressed gas source into the first chamber and (b) at least one stage valve controlling flow of gas from the first chamber to the second chamber, the stage valve being normally closed and adapted and arranged to open when pressure in the first chamber exceeds pressure in the second chamber by a predetermined margin.

8. The device as claimed in claim 1 further comprising a third chamber disposed above and coupled to the second chamber, the valve arrangement being adapted to cause the third chamber to be inflated after the second chamber.

9. The device as claimed in claim 1 comprising four or more chambers arranged to be inflated in predetermined sequence.

10. The device as claimed in claim 1 in which straps are coupled to the first chamber and provide a means for mounting the righting device to the vessel.

11. The device as claimed in claim 1 in which the second or subsequent chambers are oversized in relation to the first chamber.

12. A method of righting a boat or other vessel following capsize, comprising providing an inflatable body comprising a flexible, gas impermeable outer skin forming first and second inflatable chambers, mounting the inflatable body upon the vessel and stowing it in a collapsed, uninflated state, and following a capsize of the boat or other vessel, supplying compressed gas to the first inflatable chamber and then, following inflation of the first inflatable chamber, to the second inflatable chamber to deploy the inflatable body and cause it to right the boat or other vessel, wherein when the inflatable body is inflated and the vessel is right way up, the second inflatable chamber is disposed above the first inflatable chamber.

13. The method as claimed in claim 12 in which the inflatable body comprises three or more inflatable chambers disposed one above another, the method further comprising supplying gas to the inflatable chambers in order from the lowermost chamber to the uppermost chamber.

* * * * *